US006061881A

United States Patent [19]

Takizawa et al.

[11] Patent Number: 6,061,881

[45] Date of Patent: May 16, 2000

[54] MOLDED ENGAGING MEMBER FOR SURFACE FASTENER

[75] Inventors: Toshiaki Takizawa; Mitsuru Akeno; Tsuyoshi Minato, all of Toyama, Japan

[73] Assignee: YKK Corporation, Tokyo, Japan

[21] Appl. No.: 09/008,778

[22] Filed: Jan. 20, 1998

[30] Foreign Application Priority Data

Jan. 20, 1997 [JP] Japan ..... 9-007390

[51] Int. Cl.[7] ..... A44B 18/00

[52] U.S. Cl. ..... 24/446; 24/450; 24/452

[58] Field of Search ..... 24/442–452

[56] References Cited

U.S. PATENT DOCUMENTS

| | | | |
|---|---|---|---|
| 4,169,303 | 10/1979 | Lemelson | 24/446 X |
| 5,392,498 | 2/1995 | Goulait et al. | 24/452 |
| 5,537,720 | 7/1996 | Takizawa et al. | 24/452 |
| 5,685,050 | 11/1997 | Murasaki | 24/452 X |
| 5,702,797 | 12/1997 | Sakakibara et al. | 24/452 X |

*Primary Examiner*—James R. Brittain

*Attorney, Agent, or Firm*—Hill & Simpson

[57] ABSTRACT

There is provided a male engaging member of a surface fastener comprising novel engaging elements that are flexible to a certain extent and highly durable and, at the same time, ensure a certain level of peeling resistance. The engaging elements of such an engaging member stably remain in engagement with piles of a female engaging member coupled with it without unintentionally becoming disengaged from the piles caught by them. The engaging miember comprises a flat substrate sheet, first engaging elements having a stem and an engaging portion disposed at the top thereof and second engaging elements having a column portion and a tilted hitch portion also disposed at the top thereof, the first engaging elements and the second engaging elements being arranged in linear rows independently relative to each other. The height of the second engaging elements as measured from the surface of the substrate sheet to the top thereof is about twice as large as the height of the first engaging elements from the bottom to the top thereof. All the hook-shaped engaging portions and all the tilted hitch portions extend in the same direction in one row, the direction being opposite to the extending direction in adjacent rows.

14 Claims, 6 Drawing Sheets

MOLDED ENGAGING MEMBER FOR SURFACE FASTENER

BACKGROUND OF THE INVENTION

1. Field of the Invention

This invention relates to an engaging member of a surface fastener made of thermoplastic synthetic resin and comprising a flat substrate sheet and a large number of engaging elements injection molded integrally, more particularly, it relates to a molded engaging member of a surface fastener adapted to have a desired engaging rate, an adequate level of peeling resistance and an enhanced degree of engaging strength when used with a piece of pile product having long piles such as a carpet or some other interior decoration.

2. Description of the Related Art

In recent years, surface fasteners comprising a flat substrate sheet and a large number of male engaging elements made of a synthetic resin material and molded integrally with each other provide a wide range of applications including holders to be used with sanitary goods such as paper nappies, interior decorations, bedding articles, various sheet covers and even grind stones. The male engaging elements arranged on a flat substrate sheet may have an anchor shape or mushroom shape or show some other profile adapted to operate as hooks.

A molded engaging member of a surface fastener of the above identified type may be somewhat less flexible if compared with a conventional engaging member of a surface fastener made of woven fabric but each of its engaging elements provides greater engaging strength with loops of a companion woven surface fastener. Thus, such engaging members find ever-increasing applications including those listed above and also as holders for securely holding various industrial articles. The male engaging member of a surface fastener to be used for holding a carpet or an interior article of a motor vehicle will have to be made to show relatively large dimensions in order to have a desired degree of engaging strength, which inevitably reduces the number of hooks arranged per unit surface area (the density of engaging elements) and hence the rate of engagement of the hooks with the loops on a matching engaging member to be coupled with it is lowered. Then, in order to secure the desired engaging strength, the hooked free end of each engaging element is required to have a certain level of rigidity.

With the known molded engaging member of a surface fastener, the hooks arranged on the male engaging member are pressed by an engaging surface of a female engaging member when they are coupled with each other in such a way that the sides carrying the respective engaging elements are made to face each other. Then, as a result, the small hooks are bent either frontward or sideways to consequently close the hooks and the loops of the female engaging member are mostly forced to become flat and less apt to be caught by the hooks. Additionally, the peeling resistance of such an engaging member depends mostly on the rigidity of the hooks and hence will be reduced when the hooks are made to be highly flexible.

Thus, with known molded surface fasteners, there has been a tradeoff between the rigidity of the material and the flexibility of the fastener. If the surface fastener is molded of a highly rigid material, the engaging strength of the surface fastener will be too strong to damage the male and female engaging members when they are peeled off from each other. If, on the other hand, the surface fastener is made of a highly flexible material, engaging portions can easily be deformed and become disengaged to unintendedly separate the male and female engaging members of the fastener. Therefore, they are not adapted for holders to be used with industrial articles and interior decorations that are required to have an adequate level of engaging strength and peeling resistance.

Particularly, if the companion female engaging member is a carpet having long piles, the piles are longer than the hooks so that the hooks cannot get to the base portions of the piles and will tend to drift when engaged with corresponding piles at a top or middle portion thereof. Then, the drifting hooks engaged with the corresponding long piles only at a top or middle portion thereof can easily become disengaged when they collide with each other and hence cannot operate stably as holders.

If, similarly, the known male engaging member is pressed against a carpet having a mixture of long and short piles standing therefrom, the hooks of the engaging member having an ordinary height cannot reach the surface of the substrate sheet nor engage with the short piles as they are blocked by the long piles. If some of the hooks are successfully engaged with the short piles, they are constantly urged upward by the long piles surrounding them so that they are incessantly pulled and apt to become degraded and the short piles held by them tend to be cut by the pulling force to eventually damage the carpet. The above described situation will be applicable not only to hooks but also to engaging elements that are mushroom-shaped and those having some other profile.

Various engaging members of surface fastener have been proposed to bypass the above described drawbacks of conventional surface fasteners, particularly that of the dimensional difference between the male engaging elements of a surface fastener and the companion piles. Japanese Patent Application Laid-Open No. 8-19406 discloses such an engaging member of a surface fastener comprising a large number of identical male engaging elements arranged on a flat substrate sheet and molded integrally with it. Each of the male engaging elements have a stem rising upright from the substrate sheet, a hook-shaped engaging portion arcuately extending from part of the upper end of the stem and a branch portion extending from the remaining portion of the upper end of the stem to rise higher than the hook-shaped engaging portion to a predetermined extent and having a curved tip directed oppositely relative to the hook-shaped engaging portion, the engaging element additionally having reinforcement ribs arranged on the lateral sides of the stem.

When the engaging surface of the proposed male engaging member of a surface fastener is placed on and pressed against the engaging surface of a female engaging member to be coupled with it, the curved tips of the branch portions are pushed against the engaging surface of the female engaging member. Under this condition, the branch portion of each male engaging element is moved into the long piles of the female engaging member and eventually abuts the surface of the substrate sheet thereof to force the curved tip to bend downward and also the branch main body and the stem to turn downward around the base of the stem. As a result, the hook-shaped engaging portion arcuately extending from the stem and directed oppositely relative to the branch portion is also turned and deformed accordingly to enlarge the gap between the front end of the hook and the hook main body so that the hook can easily catch piles. At the same time, the curved tip of the branch portion slides on the engaging surface of the female engaging member so that piles are moved into the gap of the hook-shaped engaging portion and caught by the latter, while the curved tip of the branch portion is pushed into other piles.

To separate the thus coupled male and female engaging members, the female engaging member is pulled away from the male engaging member in a peeling direction. Then, the piles caught by each hook-shaped engaging portion are also pulled away with the female engaging member to turn the tip of the hook-shaped engaging portion upward. At the same time, the piles surrounding the curved tip of the branch section come to be engaged with the latter so that the piles located in front and at the back of the engaging element become in engagement with it to pull both the hook-shaped engaging portion and the curved tip of the branch portion upward to keep the stem in the upright position. Thus, the branch portion shows an effect of suppressing the bending tendency of the hook-shaped engaging portion to increase the engaging strength of the latter with regard to the piles caught by it.

The male engaging member disclosed in the above cited publication comprises for each engaging element a single stem rising substantially upright from the substrate sheet, a hook-shaped engaging portion arcuately extending from part of the upper end of the stem and a branch portion extending from the remaining portion of the upper end of the stem to rise higher than the hook-shaped engaging portion and having a curved tip directed oppositely relative to the hook-shaped engaging portion. The above described configuration of an engaging member is accompanied by the following drawbacks. Firstly, since the hook-shaped engaging portion and the branch portion share a common stem in each engaging element, the gaps of the hook-shaped engaging portions are enlarged to unintendedly release the piles of the female engaging member that have been caught by them when the coupled male and female engaging members are pressed against each other to depress and deform the branch portions.

Secondly, if the male engaging member is coupled with a female engaging member of such as a carpet so that the hook-shaped engaging portions and the branch portions brought into engagement with piles having uneven lengths, the turned and deformed hook-shaped engaging portions easily come to be engaged with short piles, and when the female engaging member is raised by the long piles standing densely, the piles engaged with the hook-shaped engaging portions are pulled by the resilient force of the branch portions trying to restore the original profile. As a result, the hook-shaped engaging sections are pulled up by the piles to become disengaged and/or damaged.

In short, these problems are caused by the fact that the male engaging member as disclosed in the above cited publication comprises for each male engaging element the hook-shaped engaging portion and the branch portion taller than the hook-shaped engaging portion extending from the common stem.

In view of the above identified problems, it is therefore the object of the present invention to provide an engaging member of a surface fastener comprising novel engaging elements that are flexible to a certain extent and at the same time, ensure a certain level of peeling resistance, and durable for repeated use. The engaging elements of an engaging member according to the invention can come evenly in engagement with long or various length of piles of a female engaging member such as a carpet and their hook-shaped engaging portions are not subjected to irregular and extreme force so that they may stably remain in engagement without unintentionally becoming disengaged from the companion piles.

SUMMARY OF THE INVENTION

According to the invention, the above object is achieved by providing an engaging member for a surface fastener made of thermoplastic synthetic resin and comprising a flat substrate sheet and a large number of engaging elements integrally molded and arranged on a surface thereof. In the engaging member, engaging elements include low first engaging elements each having a stem and an engaging portion extending from the top of the stem and second engaging elements higher than the first engaging elements and each having an upright column portion and a tilted hitch portion extending from the top of the column portion. The first engaging elements and the second engaging elements rise from the substrate sheet and are arranged independently relative to each other. Preferably, the second engaging elements have a height extending from the surface of the substrate sheet to the top thereof that is one and a half to two and a half times as large as that of the first engaging elements extending from the surface of the substrate sheet to the top thereof.

Preferably, the engaging portion has a hook-shaped profile with its front end turning downward to the surface of the substrate sheet. Alternatively, the engaging portions have a substantially semispherical profile. Each of the tilted hitch portions may be substantially linear and shows an angle θ between 90° and 150° between its axial line and that of the column portion supporting the tilted hitch portion. Alternatively, each of the tilted hitch portions may be arced at a front end thereof to become in line with the horizontal direction. Still alternatively, each of the stem and the column portions are provided with a reinforcing rib arranged at least on one of the lateral surfaces thereof that protrudes perpendicular relative to the direction in which the engaging portion or the tilted hitch portion, whichever appropriate, is extending.

Preferably, the first engaging elements and the second engaging elements are arranged in a plurality of parallel linear rows in such a way that the hook-shaped engaging portions and the tilted hitch portions are extending in opposite directions relative to each other. Adjacently located parallel rows of engaging elements may be so arranged that one row comprises only first engaging elements and the other row comprises only second engaging elements. If such is the case, the adjacent hook-shaped engaging portions of the first engaging elements in the same row are extending in opposite directions and the adjacent tilted hitch portions of the second engaging elements in the same row are extending in opposite directions. Alternatively, the first engaging elements and the second engaging elements are arranged in a plurality of straight and parallel rows in such a way that each row include both first and second engaging elements. If such is the case, the first engaging elements and the second engaging elements may be arranged alternately among adjacently located rows.

As the engaging surface of a male engaging member of a surface fastener according to the invention is pressed against a female engaging member to be coupled with it, which female engaging member may be a carpet having long piles extending from it, firstly the high second engaging elements get to the surface of the substrate sheet of the female engaging member. Then, the second engaging elements may be bent by the substrate sheet of the female engaging member but since the first engaging elements are significantly lower than the second engaging elements and the female engaging member Is supported by the second engaging elements, a distance to the female engaging member when being pressed would not be excessively short. Although the first engaging elements may have got into the piles of the female engaging member when the second engaging elements abut the surface of the substrate sheet of the female engaging member, they are not affected nor deformed by the abutting action of the second engaging elements because they are independent from the latter. In other words, the engaging portions of the first engaging elements maintain their proper profile so that they would not unintendedly be bent forward to close the gap formed at the top thereof if they have a hook-shaped profile. Thus, piles sufficiently long to be caught by the first engaging elements would easily be introduced Into the engaging portion of each of the first engaging elements.

When the force pressing the female engaging member against the male engaging member is released, the second engaging elements that have been turned and deformed by the force restore the original profile. Under this condition, the tilted hitch portions of the second engaging elements that have been entered into the piles of the female engaging member come to be engaged with short piles. On the other hand, long piles have been introduced into the engaging portions of the first engaging elements so that the first engaging elements come to be firmly engaged with the long piles to strain them as the second engaging elements restore the original profile. Note that the substrate sheet of the female engaging member is supported by the front ends of the second engaging elements to maintain a given distance between the substrate sheet of the male engaging member, and the first engaging elements would not come into mesh with the short piles of the female engaging member because the first engaging elements are not unnecessarily deformed under this condition. Thus, the first engaging elements are not subjected to excessive pulling force and protected against degradation while a desired level of engaging strength is secured to prevent the first and second engaging members from being disengaged because the first engaging elements are held in engagement with the long piles.

As described, the engaging member of the surface fastener according to the invention comprises the low first engaging elements and the high second engaging elements that are arranged independently relative to each other and adapted to hold long piles and short piles respectively and hence provide an effect of adequately and entirely anchoring the female engaging member such as a carpet that is coupled to the male engaging member. Additionally, the above described positional arrangement of first and second engaging elements ensures evenly distributed engaging strength over the entire engaging surface.

DETAILED DESCRIPTION OF THE PREFERRED EMBODIMENTS

Figure 1:
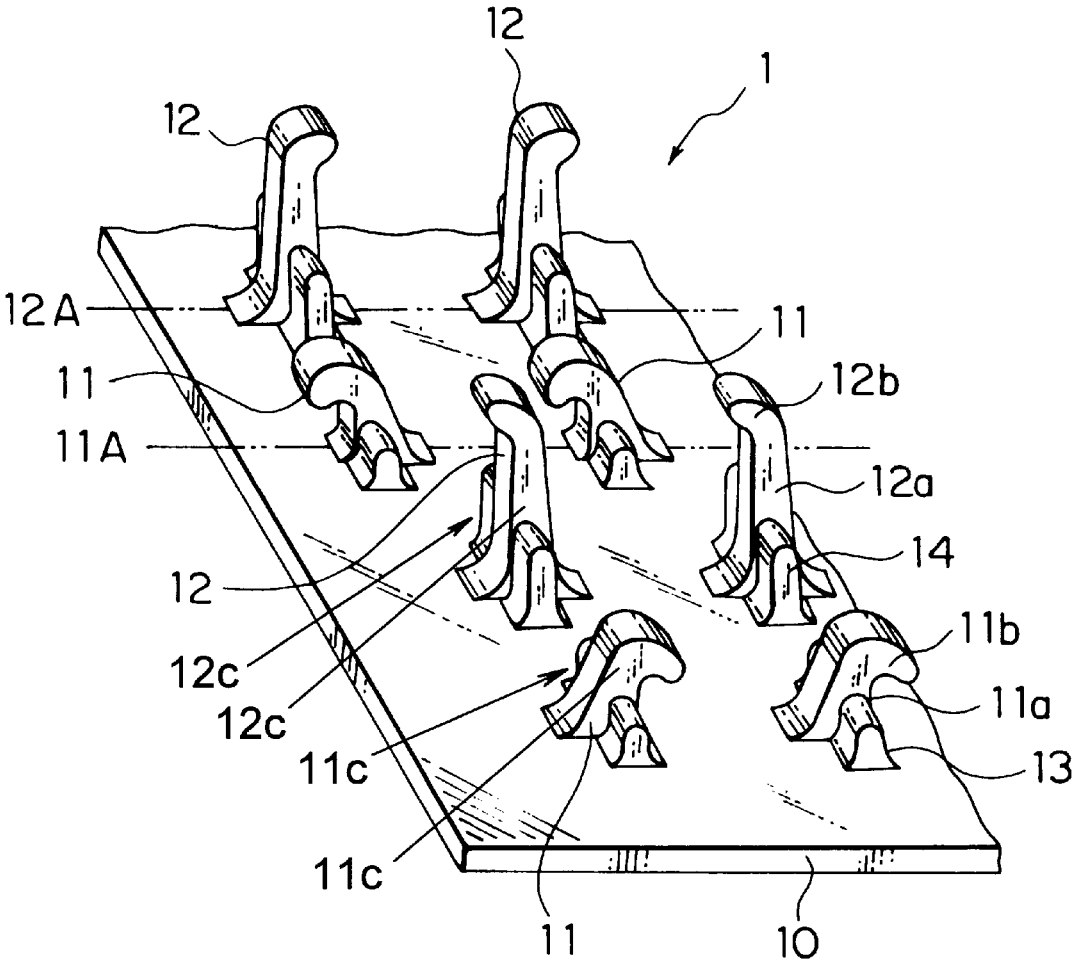
FIG. 1 is a schematic fragmentary perspective view of a first embodiment of a male engaging member of an integrally molded surface fastener according to the invention.
Figure 2:
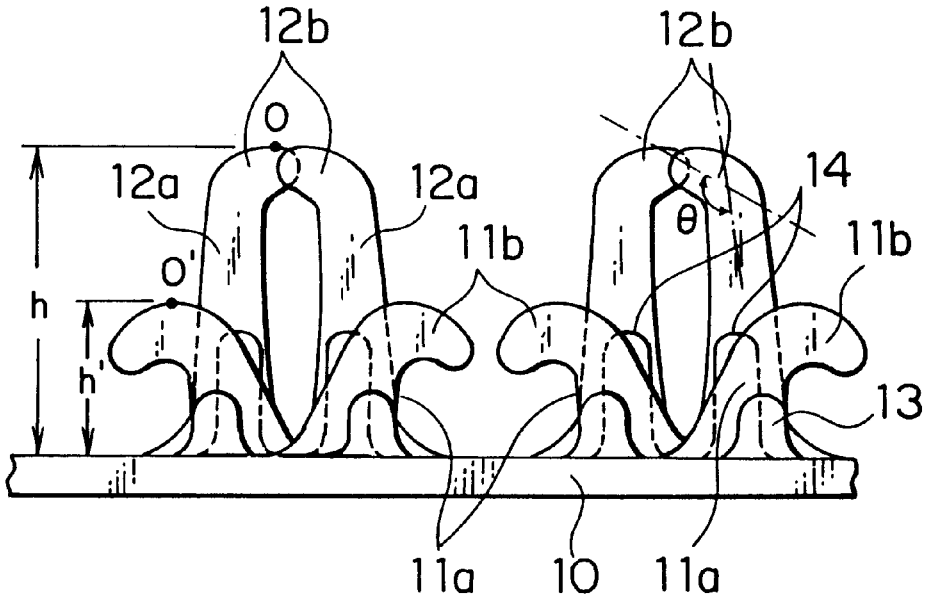
FIG. 2 is a fragmentary side view of the male engaging member FIG. 1.
Figure 3:
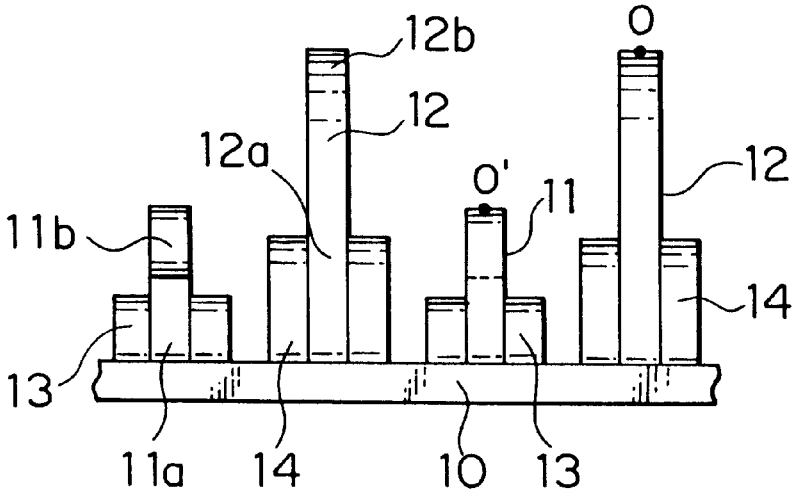
FIG. 3 is a fragmentary front view of the male engaging member of FIG. 1.

Now, the present invention will be described referring to the accompanying drawings that illustrate preferred embodiments of the invention. FIG. 1 is a fragmentary perspective view of a male engaging member according to a first embodiment of the invention, showing a structure of engaging elements. FIGS. 2 and 3 are respectively a side view and a front view of the engaging member. Referring to FIGS. 1 through 3, the embodiment comprises a flat substrate sheet 10, first engaging elements 11 and second engaging elements 12, wherein said first and second engaging elements are arranged in a large number of linear rows to produce an engaging surface of a male engaging member 1 of a surface fastener. The substrate sheet 10, the first engaging elements 11 and the second engaging elements 12 are made of a thermoplastic synthetic resin material and integrally formed by extrusion molding or injection molding.

Each of the first engaging elements 11 has a stem 11*a* rising from the substrate sheet 10 and an engaging portion 11*b* extending from the top of the stem 11*a* to engage with a companion pile. The stem 11*a* is, when seen from the side, longitudinally and upwardly tapered from the substrate sheet and reinforcing ribs 13 are provided on the lateral sides 11*c* thereof that are integral with it and protruding sideways. The engaging portion 11*b* is arcuately hook-shaped and also longitudinally tapered, its tip being directed downward toward the surface of the substrate sheet 10. All the hook-shaped engaging portions 11*b* in each row are directed in a same direction.

On the other hand, each of the second engaging elements 12 has an upright column portion 12*a* and a tapered and tilted hitch portion 12*b* that is extending aslant from the top of the column section 12*a* and adapted to enter into piles of a female engaging member to engage with some of the piles. One of the oppositely disposed longitudinal surfaces of the column portion 12*a* toward which side the tilted hitch portion 12*b* is bent is substantially upright with respect to the substrate sheet 10, whereas the other longitudinal surface is slightly inclined in the direction same as that of inclination of the tilted hitch portion 12*b*. Again, the column portion 12*a* of the second engaging element 12 is provided on the lateral sides 12*c* thereof with reinforcing ribs 14 that stands on the substrate sheet and protruding sideways. The tilted hitch portion 12*b* shows an angle θ of 120° between its axial line and that of the column portion 12*a* supporting it. All the tilted hitch portions 12*b* of the second engaging elements 12 of the same row are directed to the same direction. What is important here is that the height h of the second engaging elements 12 as measured from the surface of the substrate sheet 10 to the top O is about twice as large as the height h' of the first engaging elements 11 from the bottom to the top O' and that the first engaging elements 11 and the second engaging elements 12 are arranged independently from each other.

In the illustrated embodiment, as shown in FIG. 1, the rows 11A of the first engaging elements 11 and the rows 12A of the second engaging elements 12 are arranged alternately at regular intervals and the hook-shaped engaging portions 11*b* of the first engaging element row 11A are oppositely directed with respect to the tilted hitch portions 12*b* of the adjacent second engaging element row 12A.

Figure 4A:
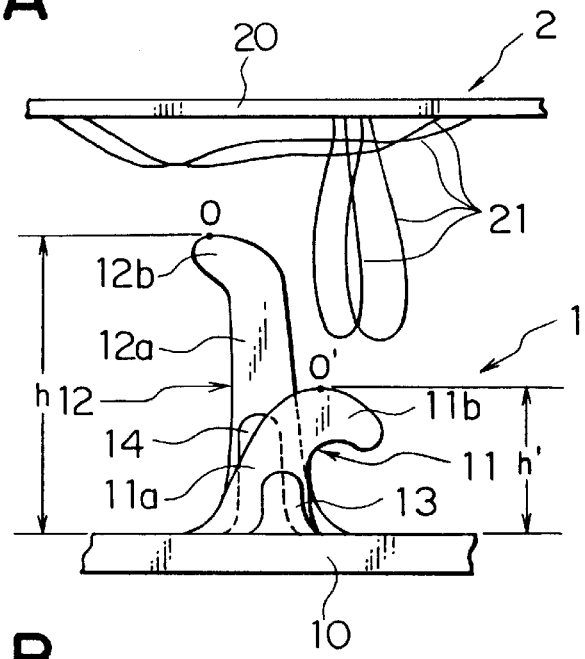
FIGS. 4(A), 4(B) and 4(C) are fragmentary side views of the male engaging member of FIG. 1, showing how the first and second engaging elements thereof come into engagement with piles of a female engaging member to be coupled with it.
Figure 4B:
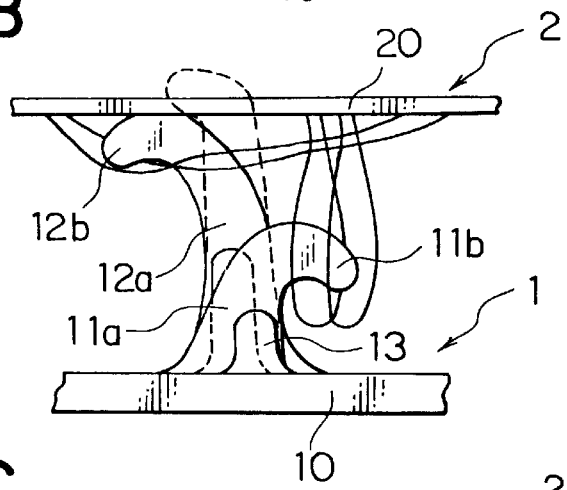
Figure 4C:
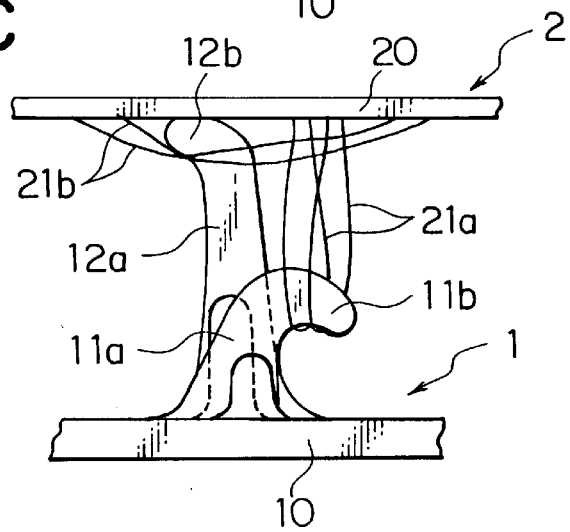

FIGS. 4A to 4C show fragmentary side views of the male engaging member 1 of FIG. 1, illustrating how the first and second engaging elements 11 and 12 thereof are engaged with and released from piles 21 of a female engaging member 2. As the member which constitutes the female engaging member 2 of surface fastener, a carpet is shown which carries thereon not piles 21 of a uniform length but a mixture of relatively long piles 21*a* and relatively short piles 21*b*. FIG. 4A shows how the first engaging elements 11 and the second engaging elements 12 appear when they are not subjected to any external force or when they come out from the mold. As seen from FIG. 4A, the top O of each of the second engaging elements 12 is located at a position with height h from the surface of the substrate sheet, which is higher than the top O' of each of the first engaging elements 11 located at a position with height h'.

FIG. 4B shows how the first and second engaging elements 11 and 12 appear when the engaging surface of the female engaging member 2 is pressed against that of the male engaging element 1. As the engaging surface of the female engaging member 2 is pressed against the engaging surface of the male engaging member 1, the engaging surface of the female engaging member 2 abuts the tilted hitch portions 12*b* of the second engaging elements 12 in such a way that the tilted hitch portions 12*b* are entered into the densely arranged piles 21 of the female engaging member 2 so that the end of the tilted hitch portion 12*b* reaches the surface of the substrate sheet 20 of the female engaging member 2. Then, each of the second engaging elements 12 is slightly turned around the base of the column portion 12*a* downwardly as being pressed and get into a tuft of short piles 21*b*, while supporting the female engaging member 2.

Since the first engaging elements 11 are sufficiently lower than the second engaging elements 12 and have a height only equal to about a half of that of the latter and the female engaging member 2 is supported by the upper free ends of the second engaging elements 12, the male engaging member 1 and the female engaging member 2 are separated by a distance greater than the height of the first engaging elements 11 so that the first engaging elements 11 do not abut the surface of the substrate sheet 20 of the female engaging member 2 and hence are only thrust into long piles 21*a* of the female engaging member 2 without being subjected to any deformation. Thus, the hook-shaped engaging portions 11*b* of the first engaging elements 11 maintain their original profile as they do not bend forward to close the gap formed at the front free end thereof nor turn sideways, so that only long piles 21*a* of the female engaging member 2 are introduced into the hook-shaped engaging portions 11*b* of the first engaging elements 11.

If the force pressing the female engaging member 2 against the male engaging member 1 is released, the second engaging elements 12 that have been slightly turned in the pressing direction and deformed restore the original profile. FIG. 4C shows how the male engaging member 1 and the female engaging member 2 are engaged with each other under this condition. Both the first engaging elements 11 and the second engaging elements 12 show their respective original profiles same as those illustrated by in FIG. 4A and that the substrate sheet of the male engaging member 1 and that of the female engaging member 2 are separated by a distance equal to the height h of the second engaging elements 12 as the latter restore the original profile. The long piles 21*a* of the female engaging member 2 are in engagement with the hook-shaped engaging portions 11*b* of the first engaging elements 11 and held in a strained state, while no short piles are held in engagement with the engaging portions 11*b*. Thus, unlike the prior art engaging member described earlier, the first engaging elements 11 are not unintendedly pulled by short piles 21*b* so that both the first engaging elements 11 and the short fibers 21*b* are kept free from damage and deterioration. Under this condition, the tilted hitch portions 12*b* of the second engaging elements 12 entered into short piles 21*b* near the surface of the substrate sheet 20 of the female engaging member 2 are held in engagement with some of the short piles 21*b* as before.

As described above, the male engaging member 1 of surface fastener according to the invention shows an enhanced level of engaging strength as a whole because the low first engaging elements 11 and the high second engaging elements 12 are respectively surely brought into engagement with long piles 21*a* and short piles 21*b* of the corresponding female engaging member 2 without being subjected to any undesired engaging force. Additionally, the mutual arrangement of the first and second engaging elements 11 and 12 as described above ensures evenly distributed engaging strength over the entire surface of the male engaging member 1 and that of the female engaging member 2.

FIG. 4B illustrates the above described surface fastener appears when the male engaging member 1 and the female engaging member 2 of the surface fastener that are held in engagement with each other are pressed further against each other. As described above, firstly the tilted hitch portions 12*b* of the second engaging elements 12 are deformed as they are pressed by the surface of the substrate sheet 20 of the female engaging member 2. However, since the first engaging elements 11 and the second engaging elements 12 are arranged independently relative to each other, the first engaging elements 11 would not be deformed as a result of the deformation of the second engaging elements 12 and hence the hook-shaped engaging portions 11*b* of the first engaging elements 11 maintain the original profile. Therefore, the first engaging elements would not release the long piles 21*a* it has caught unlike the conventional ones in which the gap of the engaging portions 11*b* are open widely.

Figure 5:
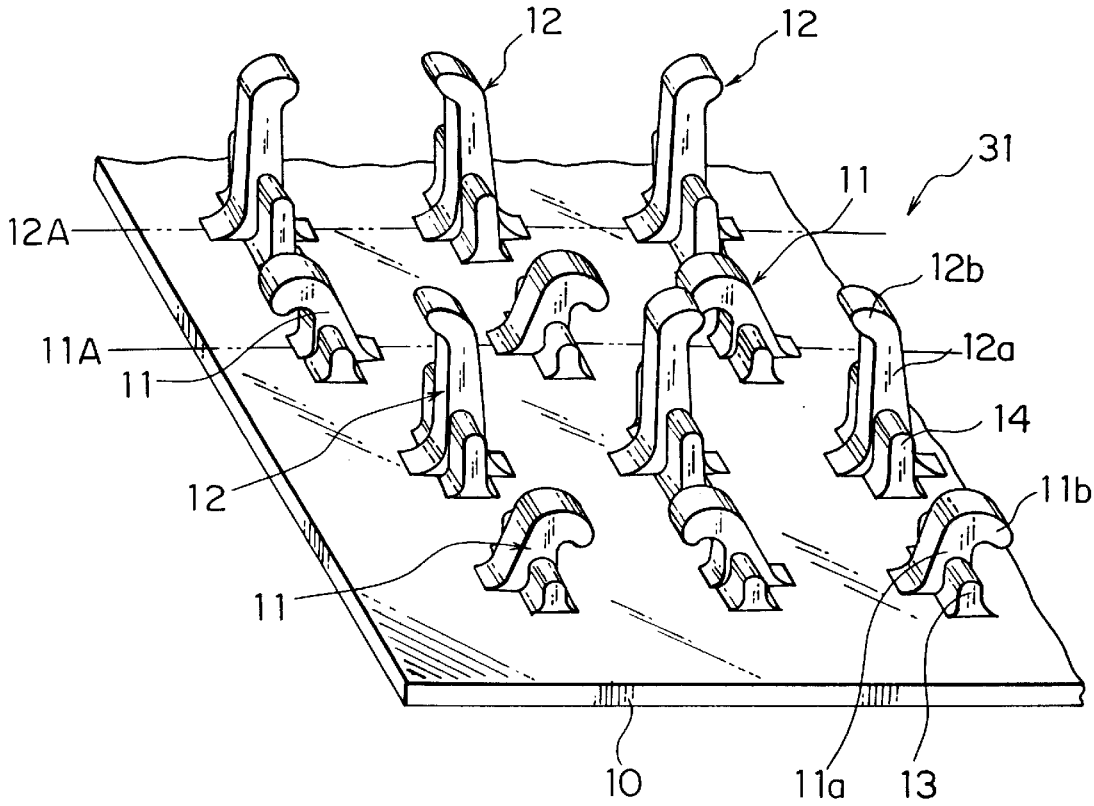
FIG. 5 is a fragmentary perspective view of the first modification of the male engaging member of FIG. 1.
Figure 6:
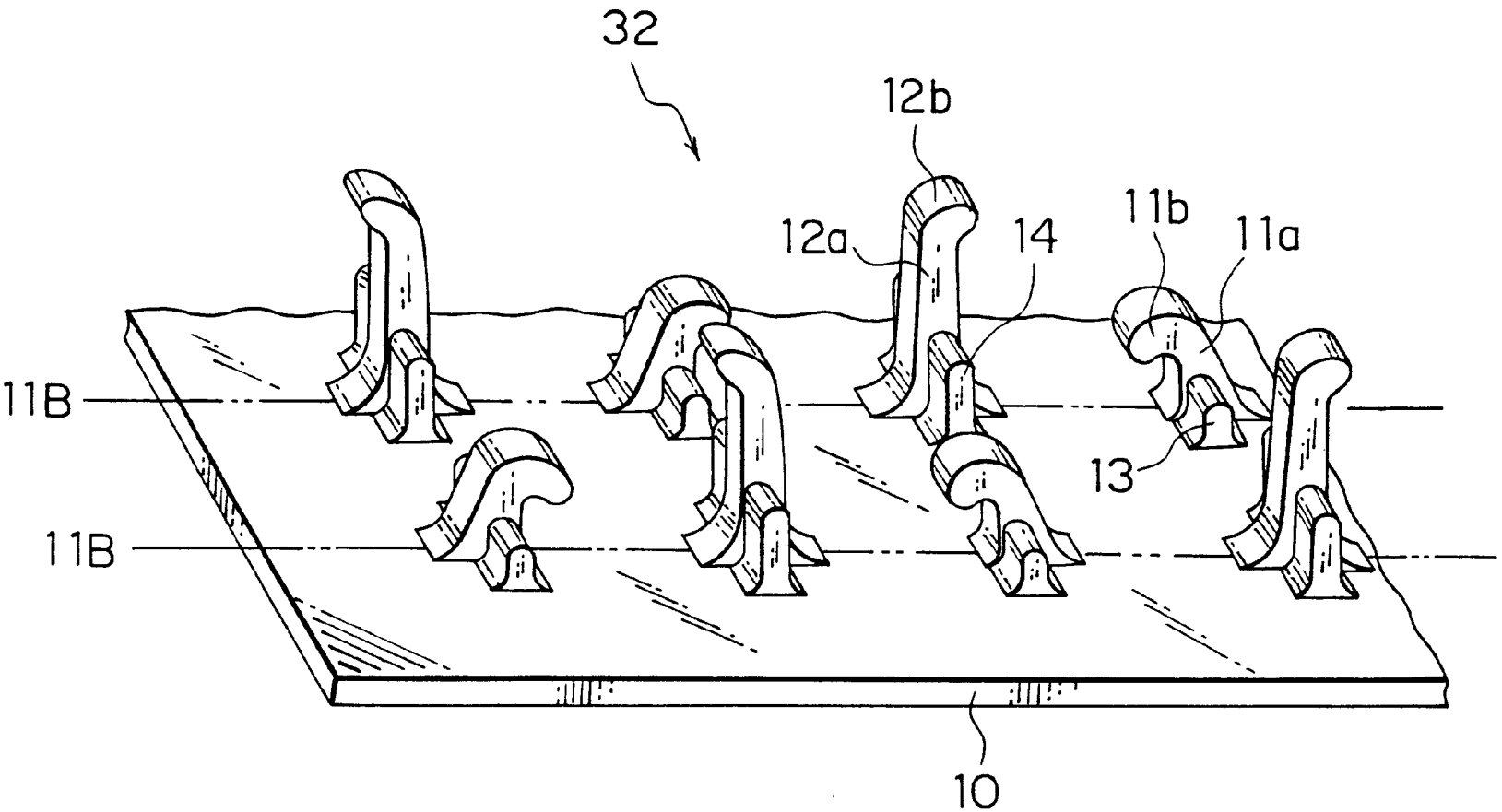
FIG. 6 is a fragmentary perspective view of the second modification of the male engaging member of FIG. 1.
Figure 7:
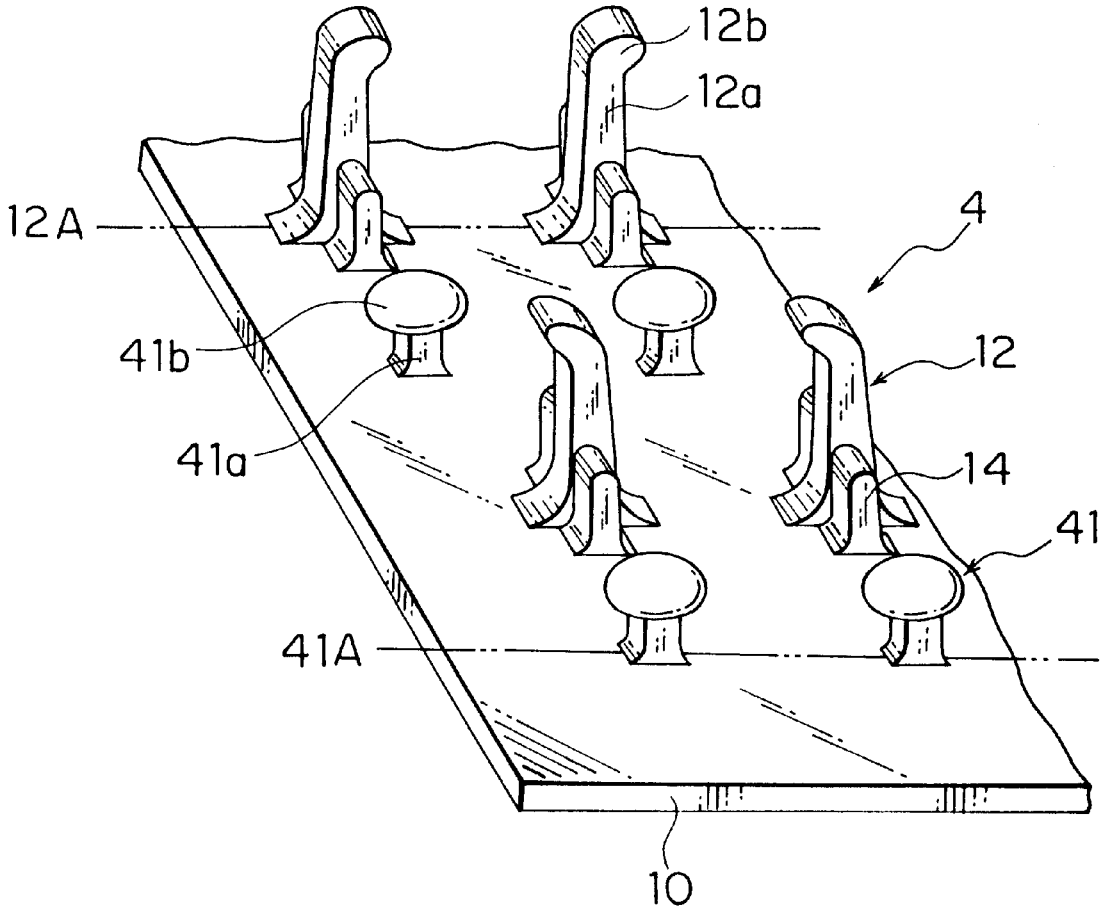
FIG. 7 is a fragmentary perspective view of a second embodiment of the male engaging member of the integrally molded surface fastener according to the invention.

FIGS. 5 through 7 show modifications of the male engaging member of surface fastener according to the first embodiment. In these modifications, both the first and second engaging elements have respective profiles that are substantially same as their counterparts of the first embodiment but are arranged differently. Therefore, the components of the modifications that are identical with those of the first embodiment are denoted respectively by the same reference numerals and will not be described any further.

FIG. 5 is a fragmentary perspective view of a first modification. As shown, the first engaging elements 11 and the second engaging elements 12 of the male engaging member 31 of surface fastener of this first modified embodiment are arranged in linear rows denoted respectively by 11A and 12A and the rows 11A of first engaging elements 11 and the rows 12A of second engaging elements 12 are arranged in an alternating manner. In the same row 11A of the first engaging elements 11, the hook-shaped engaging portions 11*b* of any adjacently located first engaging elements 11 are made to extend in opposite directions relative to each other. Likewise, in the same row 12A of second engaging elements 12, the tilted hitch portions 12*b* of any adjacently located second engaging elements 12 are made to extend in opposite directions relative to each other. At the same time, each of the hook-shaped engaging portions 11*b* of a row 1A of first engaging elements 11 is oppositely directed relative to the neighboring tilted hitch portion 12*b* of the row 12A located adjacently relative to the row 11A.

FIG. 6 is a fragmentary partial perspective view of a second modification. As shown, the first engaging elements 11 and the second engaging elements 12 of the male engaging member 32 are arranged in a plurality of linear rows 11B and each of the rows 11B comprises both first engaging elements 11 and second engaging elements 12 that are alternately disposed. In each of the rows 11B, the hook-shaped engaging portion 11*b* of one first engaging element 11 and the tilted hitch portion 12*b* of the adjacently located second engaging element 12 are made to extend in opposite directions relative to each other. At the same time, each of the first engaging elements 11 of a row 11B is located next to a second engaging element 12 of any adjacently located row, and the hook-shaped engaging portion 11*b* of the first engaging element 11 and the tilted hitch portion 12*b* of the second engaging element 12 adjacent to it are extended in opposite directions relative to each other.

The above described modifications have an effect similar to that of the first embodiment and may be selectively used depending on the application and the synthetic material of the male engaging member of surface fastener.

FIG. 7 is a fragmentary perspective view of a male engaging member 4 of surface fastener according to a second embodiment of the invention. All the components of this second embodiment are identical with their counterparts of the above described first embodiment except that the first engaging elements 41 have a profile different from that of the first engaging elements 11 of the first embodiment. Therefore, only the first engaging elements 41 of this embodiment will be described and the remaining components will be denoted respectively by the reference numerals same as those in the first embodiment without describing them any further. The male engaging member 4 comprises a substrate sheet 10, first engaging elements 41 and second engaging elements 12, the first engaging elements 41 and the second engaging elements 12 being arranged respectively in linear rows 41A and 12A to form an engaging surface of the male engaging member 4 of surface fastener. The substrate sheet 10, the first engaging elements 41 and the second engaging elements 12 are made of a thermoplastic synthetic resin material and integrally formed by extrusion molding or injection molding as in the case of the first embodiment.

Each of the first engaging elements 41 has a mushroom shape having a prism-shaped stem 41*a* rising from the substrate sheet 10 and a semispherical engaging portion 41*b* arranged on the top of the stem 41*a* and adapted to become in engagement with piles of a female engaging member. Meanwhile, the tilted hitch portions 12*b* of the second engaging elements 12 of the same row are directed in the same direction but oppositely directed relative to those of any adjacent row with a row 41A of the first engaging elements 41 interposed therebetween. In other words, each row 41A of first engaging elements 41 is arranged between a pair of rows 12A of second engaging elements 12 whose tilted hitch portions are directed oppositely relative to each other. Since the engaging portions 41*b* of the first engaging elements 41 of this second embodiment are semispherical in shape, they have a greater engaging strength than that of the hook-shaped engaging portions 11*b* of the first embodiment without any directional propensity and hence are adapted to be in engagement with fibers in all directions. However, they are apt to be hanged by piles, a phenomenon often observed in known male engaging members. Thus, the first engaging elements 41 of this embodiment need to be designed by taking the material of the embodiment and the flexibility of the material into consideration, in view of both of the engaging strength and the peeling resistance. The second embodiment is substantially as effective as the first embodiment in operation.

As is clearly understood from the above description, the above described embodiments can be modified in many different ways and various types of arrangements can be adopted. For example, while the stems 11*a*, 41*a* of the first engaging elements 11, 41 and the column portions 12*a* of the second engaging elements 12 of the above embodiments have a rectangular cross section, they may alternatively have any other appropriate cross section such as polygonal, circular or elliptic.

As described above in detail, the male engaging member 1 of surface fastener according to the invention comprises low first engaging elements 11 and high second engaging elements 12 that are arranged independently relative to each other so that it is adapted for uniform engagement with the female engaging member 2 of surface fastener comprising long piles that are longer than ordinary engaging elements or a mixture of long piles and short piles standing therefrom. Additionally, the second engaging elements 12 serve to support the coupled female engaging member 2 and maintaining a distance between the engaging surface of the male engaging member 1 and that of the female engaging member 2 appropriate to enable proper engagement of the first engaging element 11 with the long piles 21. Thus, long piles caught by the first engaging elements 11 are held in engagement with the latter with an appropriate level of engaging strength without being slackened while short piles 21*b* are engaged with the tilted hitch portions 12*b* of the second engaging elements 12 so that an adequate level of engaging strength can be obtained easily.

If force is applied to press the male engaging member 1 of the present invention against the companion female engaging member in engagement, the tilted hitch portions 12*b* of the second engaging elements 12 securely support the engaging surface of the female engaging member 2 to prevent the two engaging members 1, 2 being brought too close to each other. Additionally, since the first engaging elements 11 and the second engaging elements 12 are arranged independently relative to each other, the first engaging elements 11 would be exempted from any incidental deformation due to a deformation of the second engaging elements 12 so that the piles caught by the first engaging elements 11 would not be released from the mating piles and the mutual engagement of the first and second engaging members 1, 2 would be sustained without problem.

What is claimed is:

1. An engaging member for a surface fastener made of thermoplastic synthetic resin comprising:

a flat substrate sheet;

a large number of engaging elements molded integrally with said substrate sheet;

first engaging elements provided on a surface of said substrate sheet, each first engaging element having a stem and an engaging portion disposed at the top of said stem;

second engaging elements provided on the surface of said substrate sheet, each second engaging element being higher than each of said first engaging elements and having a column portion and a tilted hitch portion disposed at the top of said column portion; and said first engaging elements and said second engaging elements rising from the surface of said substrate sheet and being arranged independently relative to each other, each stem of each first engaging element having a substantially vertical lateral side facing generally toward a lateral side of one of said tilted hitch portions of said second engaging elements.

2. An engaging member according to claim 1, wherein said second engaging elements have a height (h) extending from the surface of said substrate sheet to the top (O) thereof that is one and a half to two and a half times as large as the height (h') of said first engaging elements also extending from the surface of said substrate sheet to the top (O') thereof.

3. An engaging member according to claim 1, wherein said engaging portion has a hook-shaped profile with its front end turning downward to the surface of the substrate sheet.

4. An engaging member according to claim 3, wherein said first engaging elements and said second engaging elements are arranged in a plurality of parallel linear rows in such a way that said hook-shaped engaging portions and said tilted hitch portions are extending in opposite directions relative to each other.

5. An engaging member according to claim 1, wherein said engaging portions has a substantially semispherical profile.

6. An engaging member according to claim 1, wherein each of said tilted hitch portions is substantially linear and shows an angle θ between 90° and 150° between its axial line and that of said column portion supporting said tilted hitch portion.

7. An engaging member according to claim 1, wherein each of said tilted hitch portions is arced at a front end thereof to become in line with the horizontal direction.

8. An engaging member according to claim 1, wherein each of said stems and said column portions are provided with a reinforcing rib or ribs arranged respectively on one of or on both of the lateral surfaces thereof that protrude perpendicular relative to the direction in which said engaging section or said tilted hitch portion, whichever appropriate, is extending.

9. An engaging member according to claim 1, wherein adjacently located parallel rows of engaging elements are so arranged that one row comprises only first engaging elements and the other row comprises only second engaging elements.

10. An engaging member according to claim 9, wherein the adjacent hook-shaped engaging portions of said first engaging elements in the same row are extending in opposite directions and the tilted adjacent hitch portions of said second engaging elements in the same row are extending in opposite directions.

11. An engaging member according to claim 9, wherein said first engaging elements and said second engaging elements are arranged alternately among adjacently located rows.

12. An engaging member according to claim 1, wherein said first engaging elements and said second engaging elements are arranged in a plurality of straight and parallel rows in such a way that each row include both first and second engaging elements.

13. An engaging member for a surface fastener made of thermoplastic synthetic resin comprising:

a flat substrate sheet;

a large number of engaging elements molded integrally with said substrate sheet;

first engaging elements provided on a surface of said substrate sheet, each first engaging element having a stem and an engaging portion disposed at the top of said stem;

second engaging elements provided on the surface of said substrate sheet, each second engaging element being higher than each of said first engaging elements and having a column portion and a tilted hitch portion disposed at the top of said column portion; and said first engaging elements and said second engaging elements rising from the surface of said substrate sheet and being arranged independently relative to each other;

said engaging portions having a substantially semispherical profile.

14. An engaging member for a surface fastener made of thermoplastic synthetic resin comprising:

a flat substrate sheet;

a large number of engaging elements molded integrally with said substrate sheet;

first engaging elements provided on a surface of said substrate sheet, each first engaging element having a stem and an engaging portion disposed at the top of said stem;

second engaging elements provided on the surface of said substrate sheet, each second engaging element being higher than each of said first engaging elements and having a column portion and a tilted hitch portion disposed at the top of said column portion; and said first engaging elements and said second engaging elements rising from the surface of said substrate sheet and being arranged independently relative to each other;

wherein adjacently located parallel rows of engaging elements are so arranged that one row comprises only first engaging elements and the other row comprises only second engaging elements;

wherein the adjacent hook-shaped engaging portions of said first engaging elements in the same row are extending in opposite directions and the tilted adjacent hitch portions of said second engaging elements in the same row are extending in opposite directions.

* * * * *